United States Patent [19]

Labbé et al.

[11] 4,366,683

[45] Jan. 4, 1983

[54] LOCKING LATCH FOR A HATCH DOOR OR THE LIKE

[76] Inventors: Kirk Labbé, 1749 Antonio Barbeau St., Vimont, Canada, H7M 3P9; Jacques Leveille, 241 Brien St., Laval, Canada, H7N 3M6

[21] Appl. No.: 232,983

[22] Filed: Feb. 9, 1981

[51] Int. Cl.[3] ..... E05B 73/00

[52] U.S. Cl. ..... 70/19; 70/123; 70/211

[58] Field of Search ..... 70/19, 115, 116, 122, 70/123, 210, 211; 292/66, 200, 226, DIG. 31, DIG. 49

[56] References Cited

U.S. PATENT DOCUMENTS

| | | | |
|---|---|---|---|
| 2,053,547 | 9/1936 | Austin | 70/123 |
| 2,729,490 | 1/1956 | Gander | 292/DIG. 49 |
| 3,051,520 | 8/1962 | Poe | 292/DIG. 49 |
| 3,214,207 | 10/1965 | Swanson | 292/66 |
| 4,196,602 | 4/1980 | Akselsen | 70/211 |
| 4,335,595 | 6/1982 | Swan | 292/DIG. 31 |

FOREIGN PATENT DOCUMENTS 967386 5/1975 Canada .

*Primary Examiner*—Robert L. Wolfe

[57] ABSTRACT

A clamping latch for a hatch door of a car or the like closure and characterized by a locking feature to prevent unclamping of such latch by mere banging on the hatch door and to thus provide unauthorized removal of such hatch door and entry into a car so equipped, as some sport cars now are. This locking latch comprises a clamping latch member that pivotally clamps against the rim around the access aperture closed by the hatch door and a key lock fixedly securing the clamping latch member in latching position.

7 Claims, 3 Drawing Figures

LOCKING LATCH FOR A HATCH DOOR OR THE LIKE

This invention relates to a latch that is lockable and of the type such as used in cars to clampingly secure a hatch door closing an access aperture in the vehicle body. Such clamping latch is also adapted for the like closures wherever used.

The clamping latch of the above type that is now known and used is secured against the inside face of a hatch door along one of its edges with a clamping latch member that pivotally clamps the rim defined around the corresponding access aperture in the vehicle body. It has been found that a firm blow on the outside surface of the hatch door allows to free the clamping latch member from clamping engagement with the rim. Thus, that clamping latch is not tamper-proof and those cars can thus, too, easily be stolen.

It is a general object of the present invention to provide a clamping latch of the above type with a lock to prevent tampering with such latch and to thus prevent unauthorized entry into a vehicle with a hatch door secured with such latch.

It is a more specific object of the present invention to provide a locking latch of the above type which cannot be unclamped by externally tampering with a hatch door so equipped, such as by banging on the latter.

It is a further object of the present invention to provide a locking latch of the above type, which is of simple construction and reliable operation.

The present invention defines a clamping latch for a hatch door of a car or the like closure and characterized by a locking feature to prevent unclamping of such latch by mere banging on the hatch door and to thus provide unauthorized removal of such hatch door and entry into a car so equipped, as some sport cars now are. This locking latch comprises a clamping latch member that pivotally clamps against the rim around the access aperture closed by the hatch door and a key lock fixedly securing the clamping latch member in latching position.

Figure 1:
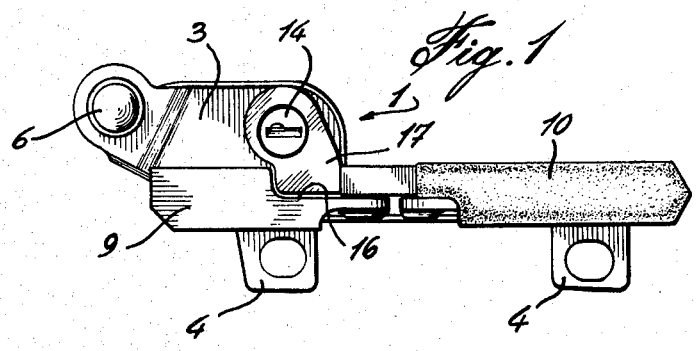
Figure 2:
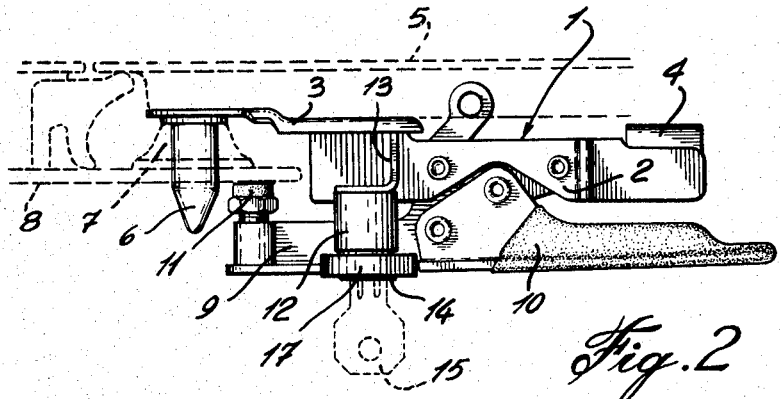
Figure 3:
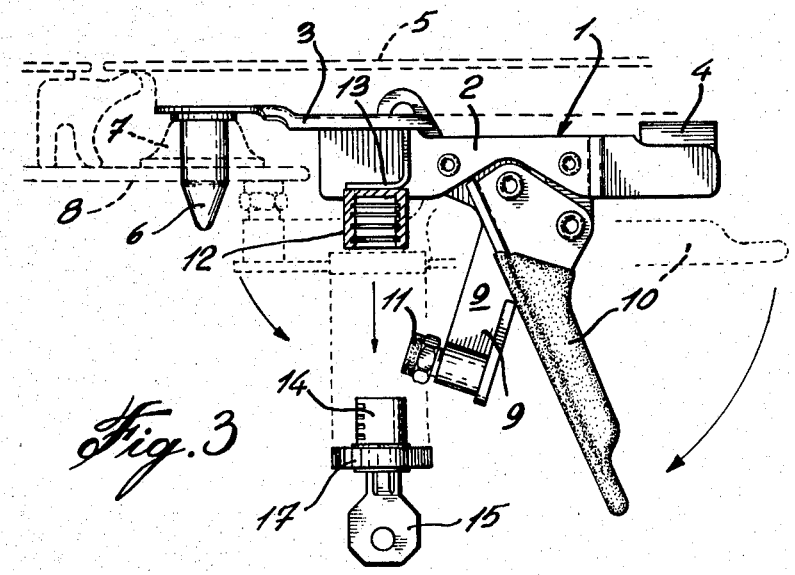

The above and other objects and advantages of the present invention will be better understood with reference to the following detailed description of a preferred embodiment thereof which is illustrated, by way of example, in the accompanying drawing, in which:

FIG. 1 is a plan view of a locking latch for a hatch door or the like according to the present invention; and FIGS. 2 and 3 are side views of the same latch in locked and unlocked positions, respectively.

The illustrated latch comprises a supporting or mounting bracket 1 having a main body portion 2 and a fixed clamping portion 3. The main body portion is provided with lugs, or ears 4, to be fixedly secured against the inside face of a hatch door 5, or the like, adjacent one of its edges. The fixed clamping portion 3 is provided with a stud 6 inwardly projecting from it and fitting into a corresponding resilient annular boss 7, of rubber or the like, fixedly secured to the rim 8 of a corresponding access aperture in the body of the car or vehicle and which is closed by the hatch door 5.

A clamping latch lever 9 and an actuating hand lever 10 are pivotally connected relative to the main body portion 2 of the mounting bracket 1 and relative to each other in toggle lever action, as is well known in particular in the afore-mentioned latch of the prior art. The clamping latch lever 9 is pivoted to clampingly engage the opposite side of the rim 8 relative to the fixed clamping portion 3. The clamping lever 9 is provided with a soft contact pad 11 adjustably mounted on it.

A tubular body 12 is fixedly secured by a bracket 13 to the supporting bracket 1 and axially projects inwardly. The inside of the tubular body 12 is provided with abutments and arranged to form a holder for a locking cylinder 14. The latter is provided, in any well known manner, with tumblers, not shown, that lockingly engage the appropriate abutments in the locking cylinder holder 12, upon actuation by a key 15.

The clamping latch lever 9 is formed with a catching notch 16 in which fits a locking latch 17 fixedly secured to the locking cylinder 14 and cooperatively forming with it a locking cylinder assembly.

After the actuating handle 10 has been pivoted from the position of FIG. 3 to the position of FIG. 2, the locking cylinder assembly may be engaged in the locking cylinder holder 12 and locked in it by the key 15 with the locking latch 17 fitting in the catch 16. Thus, even if one bangs on the hatch door 5 to cause the toggle linkage to open, the lock holds the clamping latch lever 9 in clamping position.

What we claim is:

1. A locking latch for a hatch door or the like closure adapted to engage a rim defined around an access aperture in a vehicle body with the locking latch comprising a supporting bracket fixedly securable against the inside face of the hatch door along one edge thereof, a clamping latch member movably connected to the supporting bracket and clampingly engageable in latching engagement against the rim defined around the access aperture, a locking cylinder holder fixedly secured relative to the supporting bracket and constructed and arranged for engagement of a lock cylinder therein, and a locking cylinder assembly engaging the locking cylinder holder and the clamping latch member and operatively locking the latter in the latching engagement thereof against the rim defined around the access aperture.

2. A locking latch as defined in claim 1, wherein the locking cylinder assembly includes a locking cylinder and a locking latch member fixedly secured to the locking cylinder and lockingly engaging the clamping latch member.

3. A locking latch as defined in claim 2, wherein the clamping latch member includes a catch and the locking latch member lockingly engages the catch of the clamping latch member and is constructed and arranged to immobilize the latter.

4. A locking latch as defined in claim 3, wherein said locking cylinder holder includes a cylindrical body having an open end for axial engagement of the locking cylinder therein and having internal abutments, and the locking cylinder engages in the cylindrical body and lockingly engages the internal abutments therein, concurrently holding the locking latch member in locking engagement with said catch.

5. A locking latch as defined in claim 4, wherein the supporting bracket includes a clamping portion clampingly engageable with said rim on opposite side thereof relative to the clamping latch member.

6. A locking latch as defined in claim 5, wherein the clamping latch member is pivoted to the supporting bracket toward and away relative to clamping engagement with said rim and relative to the supporting bracket.

7. A locking latch as defined in claim 6, wherein the clamping latch member includes a notched portion operatively defining a catching notch constructed and arranged for locking engagement of the locking latch member therein.

* * * * *